US005145724A

United States Patent [19]

Yanai et al.

[11] Patent Number: 5,145,724

[45] Date of Patent: Sep. 8, 1992

[54] METHOD OF MAKING A CLEANING BLADE COATED WITH GRAPHITE FLUORIDE

[75] Inventors: Noriyuki Yanai; Masahiro Watabe, both of Yokohama, Japan

[73] Assignee: Canon Kabushiki Kaisha, Tokyo, Japan

[21] Appl. No.: 829,593

[22] Filed: Feb. 3, 1992

Related U.S. Application Data

[63] Continuation of Ser. No. 480,910, Feb. 16, 1990, abandoned.

[30] Foreign Application Priority Data

Feb. 20, 1989 [JP] Japan ..... 1-41357
Apr. 28, 1989 [JP] Japan ..... 1-109516

[51] Int. Cl.[5] ..... B05D 1/18

[52] U.S. Cl. ..... 427/430.1; 15/256.51; 118/652; 355/299; 427/180; 430/125

[58] Field of Search ..... 427/145, 180, 430.1; 15/1.51, 256.5, 256.51; 118/652; 355/296, 299; 430/125

[56] References Cited

U.S. PATENT DOCUMENTS 3,936,183 2/1976 Sadamatsu ..... 15/256.5 X
4,970,560 11/1990 Lindblad et al. ..... 355/299

FOREIGN PATENT DOCUMENTS 2324749 12/1974 Fed. Rep. of Germany .
0028231 8/1976 Japan ..... 355/299
57-64278 4/1982 Japan ..... 355/299
0203480 11/1983 Japan ..... 355/299
0048881 3/1986 Japan ..... 355/299
61-48881 3/1986 Japan .
0048882 3/1986 Japan ..... 355/299
61-239279 10/1986 Japan ..... 355/299
0255375 11/1986 Japan ..... 355/299
62-102271 5/1987 Japan .
63-58481 3/1988 Japan .
1376865 12/1974 United Kingdom .
8905000 6/1989 World Int. Prop. O. ..... 355/299

OTHER PUBLICATIONS

Spencer, Paul R. and Donald J. Fisher, "Impregnated Poromeric Material Cleaning Blade", Xerox Disclosure Journal, vol. 1, No. 4, (Apr. 1976) p. 79.

*Primary Examiner*—Shrive Beck
*Assistant Examiner*—Terry J. Owens
*Attorney, Agent, or Firm*—Fitzpatrick, Cella, Harper & Scinto

[57] ABSTRACT

The cleaning portion of a cleaning blade made of an elastomeric material is coated with graphite fluoride by applying graphite fluoride powder directly to the blade or applying to the blade a dispersion of graphite fluoride powder in a solvent and evaporating the solvent. Alternatively, graphite fluoride powder can be mixed with the elastomeric material from which the cleaning portion of the cleaning blade is formed.

6 Claims, 1 Drawing Sheet

METHOD OF MAKING A CLEANING BLADE COATED WITH GRAPHITE FLUORIDE

This application is a continuation of application Ser. No. 07/480,910 field Feb. 16, 1990, now abandoned.

BACKGROUND OF THE INVENTION

1. Field of the Invention

The present invention relates to a cleaning blade, and more particularly, to a cleaning blade used for an electrophotographic apparatus. It also relates to an electrophotographic apparatus making use of the cleaning blade.

2. Related Background Art

The cleaning blade is a plate-like molded product mainly comprising a polyurethane elastomeric material. When applied to an electrophotographic photosensitive member, the cleaning blade is used for the purpose of physically cleaning and removing the toner adhered to the surface of the photosensitive member, by bringing the blade into contact with the surface. In such an instance, however, the blade must resist the electrostatic attraction force of toner particles, exerted to the surface of the photosensitive member, before it can remove the toner particles from the surface of the photosensitive member. Hence, it must be pressed against the surface of the photosensitive member with a great pressure. Thus, a great frictional force is produced between the photosensitive member and the cleaning blade, and therefore it may occur that the cleaning blade is turned and reversed, resulting in no drive of the photosensitive member or no cleaning operation, or that the surface of the photosensitive member is scraped when it is made of a soft material, bringing about defective images or a short life of the photosensitive member. Particularly at the stage of its initial use, the drum surface is so smooth that adhesion may occur between the drum surface and the blade, tending for the blade to be turned over.

To solve such problems, measures have been hitherto taken such that powder of fluorocarbon resin such as PTFE or PVDF is applied to or incorporated into the top of a blade in order to prevent the turnover at its initial use. However, the method in which the fluorocarbon resin powder is applied to the top of the blade has been involved in the problem that an electrical memory remains on the photosensitive drum to cause formation of a defective image at the initial stage. In the instance where the fluorocarbon resin is incorporated into the top of the blade, problems may arise such that the fluorocarbon resin falls off in the course of cleaning because of an insufficiency of the retension power of rubber to the fluorocarbon resin, so that the toner may slip through the part at which the resin has fallen off, resulting in lowering of the cleaning performance.

SUMMARY OF THE INVENTION

Accordingly, an object of the present invention is to provide a cleaning blade capable of remarkably lowering the frictional force between the cleaning blade and photosensitive member, thereby preventing the turnover of the blade at its initial use and also obtaining a good image without causing any memory to remain on the surface of the photosensitive member.

Another object of the present invention is to provide an electrophotographic apparatus capable of producing a sharp copy with good cleaning performance.

The present invention provides a cleaning blade comprising a blade of an elastomeric material, wherein at least the top of said blade of an elastomeric material comprises powder of a graphite fluoride.

The present invention also provides an electrophotographic apparatus comprising such a cleaning blade.

The graphite fluoride powder may be present in at least the top of the cleaning blade in the state that the former has been applied to, or incorporated into, the latter. The cleaning blade according to the present invention can give superior cleaning effect without adversely affecting images.

DESCRIPTION OF THE PREFERRED EMBODIMENTS

Figure 1:
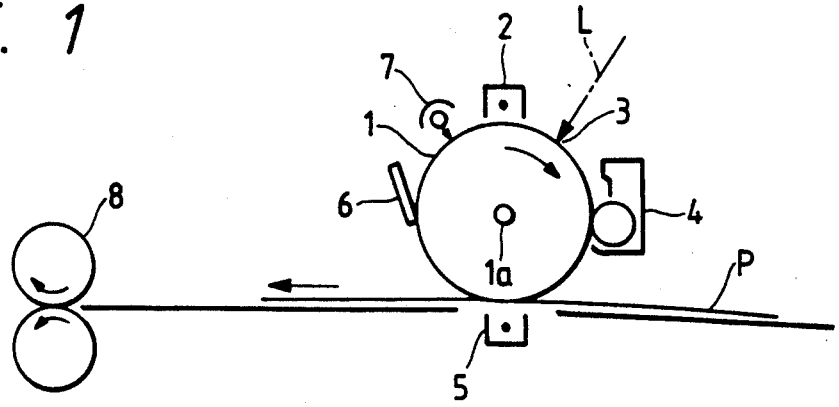
FIG. 1 illustrates a schematic construction of an electrophotographic apparatus in which the cleaning blade according to the present invention is used.

The graphite fluoride usable in the present invention includes, for example, a $(C_2F)_n$ type Cefbon DM (a product of Central Glass Co., Ltd.), a $(CF)_n$ type Cefbon CMA, Cefbon CMF (products of Central Glass Co., Ltd.), Carbon Fluoride #2065, #1030, #1000 (products of Asahi Glass Co., Ltd.), CF-100 (Nippon Carbon Co., Ltd.), and Carbon Fluoride #2028, #2010 (products of Asahi Glass Co., Ltd.), which belong to a $(CF)_n$ type wherein the rate of fluorination has been changed, as well as those obtained by treating any of the above graphite fluorides with a base such as amine to remove the fluorine present at the surface. The graphite fluoride, however, is by no means limited to these examples. In the instance where the graphite fluoride powder is "applied", it may preferably have an average particle diameter of not more than 20 μm, and particularly in the range of from 1 μm to 8 μm, so as not to give a difficulty in the cleaning of toner.

In the instance where the graphite fluoride powder is "incorporated", it may preferably have an average particle diameter of not more than 10 μm from the viewpoints of dispersibility, molding properties, etc. Here, the graphite fluoride powder may be contained in an amount of from 1 to 70 parts by weight, and particularly from 10 to 50 parts by weight, based on 100 parts by weight of the elastomeric material.

The average particle diameter of the graphite fluoride powder can be measured using a centrifugal sedimentation particle grain size distribution measuring apparatus (trade name: SA-CP2 Type; manufactured by Shimazu Corporation), by the use of ethanol as a dispersion medium.

In the instance where the graphite fluoride powder is applied in manufacturing a cleaning blade, the graphite fluoride powder may be directly applied to the surface of a plate-like or chip-like cleaning blade, or the blade may be dipped in a disperion of the graphite fluoride powder in a suitable solvent, followed by evaporation of the solvent. The solvent used here may be any of those in which the graphite fluoride powder can be uniformly dispersed, and includes, for example, solvents of a fluorocarbon type.

The graphite fluoride powder must be applied to or incorporated into at least the top of the elastomeric-material blade that comes into touch with the photosensitive member.

The whole elastomeric-material blade may be formed of an elastomeric body, or may be formed of an elastomeric material top member which is separately molded and fixed to an elastomeric body previously molded.

Alternatively, the graphite fluoride powder may be previously applied to the surface of a cylindrical photosensitive member and the photosensitive member may be rotated, whereby the graphite fluoride powder can be adhered to the cleaning blade coming into touch with the photosensitive member, so that the graphite fluoride powder can be applied to the top of the cleaning blade through an indirect means.

In the instance where the graphite fluoride powder is incorporated into the cleaning blade in its manufacture, an elastomeric body forming material in which the graphite fluoride powder has been dispersed may be cured by heating.

As to the shape of the cleaning blade, it may be plate-like or chip-like. The cleaning blade may be formed as a molded product entirely comprised of an elastomeric material containing the graphite fluoride powder, or may be formed of elastomeric body comprising the graphite fluoride powder, fixed only to the top of an elastomeric body blade previously molded. Here, the elastomeric body to be fixed to the top may preferably be fixed over the whole area of the top, but may alternatively be fixed only to the top edge coming into touch with the photosensitive member. When fixed only to the top, both the elastomeric bodies may preferably be made of materials identical or analogous to each other in view of the adhesiveness.

The graphite fluoride powder is comprised of flake crystals, and appearently takes an indefinite form. Hence, in the instance where the graphite fluoride powder is incorporated into the elastomeric body, a stronger retension power of rubber to the graphite fluoride powder can be achieved. Thus, the graphite fluoride powder does not fall off in the course of cleaning. Observation of the surface of the elastomeric body incorporated with the graphite fluoride powder reveals that graphite fluoride powder particles protrude from the surface, which surface is not covered with the filmy layer as in the case when the fluorocarbon resin is used. Thus, it is possible to achieve a low coefficient of friction even at the initial stage of cleaning.

The elastomeric material includes, for example, materials having elastomeric properties, such as polyurethane rubbers, silicone rubbers, nitrile rubbers, and chloroprene rubbers. From the viewpoints of wear resistance and permanent deformation, polyurethane rubbers are preferred. In the case of the polyurethane rubbers, two-pack thermosetting polyurethane rubbers are particularly preferred because of their small permanent distortion. As a curing agent, commonly available curing agents for polurethane rubber can be used, as exemplified by 1,4-butanediol, 1,6-hexanediol, hydroquinonediethylol ether, bisphenol A, trimethylolpropane, and trimethylolethane.

FIG. 1 illustrates a schematic construction of a commonly available transfer-type electrophotographic apparatus in which the cleaning blade according to the present invention and a drum photosensitive member are used.

In FIG. 1, the numeral 1 denotes a drum photosensitive member serving as an image carrier member, which is rotated around a shaft 1*a* at a given peripheral speed in the direction shown by arrow. In the course of rotation, the photosensitive member 1 is uniformly charged on its periphery, with positive or negative given potential by the operation of a charging means 2, and then photoimagewise exposed to light L (slit exposure, laser beam scanning exposure, etc.) at an exposure area 3 by the operation of an imagewise exposure means (not shown). As a result, electrostatic latent images corresponding to the exposure images are successively formed on the periphery of the photosensitive member.

The electrostatic latent images thus formed are subsequently developed by toner by the operation of a developing means 4. The resulting toner-developed images are then successively transferred by the operation of a transfer means, to the surface of a transfer medium P fed from a paper feed section (not shown) to the part between the photosensitive member 1 and the transfer means 5 in the manner synchronized with the rotation of the photosensitive member 1.

The transfer medium P on which the images have been transferred is separated from the surface of the photosensitive member and led through an image-fixing means 8, where the images are fixed and then delivered to the outside as a transcript (a copy).

The surface of the photosensitive member 1 after the transfer of images is brought to removal of the toner remaining after the transfer, using the cleaning blade 6. Thus the photosensitve member 1 is cleaned on its surface and then repeatedly used for the formation of images.

The charging means 2 for given uniform charge on the photosensitive member 1 includes corona chargers, which are commonly put into wide use. As the transfer means 5, corona transfer units are also commonly put into wide use.

The electrophotographic apparatus may be constituted of a combination of plural components joined as one apparatus unit from among the constituents such as the above photosensitive member, developing means and cleaning blade so that the unit can be freely mounted on or detached from the body of the apparatus. For example, the photosensitive member 1 and the cleaning blade 6 may be joined into one apparatus unit so that the unit can be freely mounted or detached using a guide means such as a rail provided in the body of the apparatus. Here, the above apparatus unit may be so constituted as to be joined together with the charge means and/or the developing means.

The cleaning blade of the present invention is particularly preferred when used for an organic photosensitive member having the surface formed of a resin layer, on account of the prevention of the blade turn-over and the memory remaining.

Employment of the cleaning blade of the present invention can bring about a remarkable decrease in the coefficient of friction, thus preventing the turn-over of the blade at its initial use and also obtaining a good image even at the initial stage without causing any memory to remain on the drum.

EXAMPLES

The present invention will be described below in greater detail by giving Examples. In the following, "part(s)" is by weight.

EXAMPLE 1

Elastomeric Body Forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Curing agents: | |
| 1,4-butanediol | 3.9 parts |
| Trimethylolpropane | 2.1 parts |
| Graphite fluoride powder: Cefbon-CMA (a product of Central Glass Co., Ltd.; average particle diameter: 3 μm) | |

Figure 2:
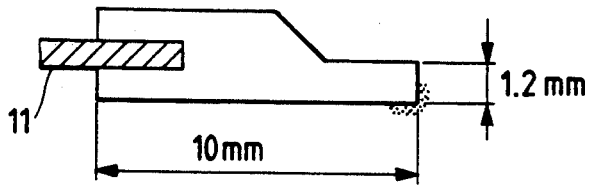
FIG. 2 is a diagrammatic cross section of the cleaning blade of the present invention.

The curing agents, 1,4-butanediol and trimethylolpropane, were mixed into heat-melted urethane prepolymer. The mixture was casted in a mold previously fitted with a plate metal, and then cured by heating. The cured product was taken out of the mold and cut to form a cleaning blade made of polyurethane, of 10 mm in width, 130 mm in total length and 1.2 mm in thickness at the top. The graphite fluoride powder was rubbed over the top of the cleaning blade. The cleaning blade of the present invention was thus prepared. FIG. 2 shows a cross section of this cleaning blade. In FIG. 2, the numeral 11 denotes the plate metal.

EXAMPLE 2

Elastomeric Body Forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Curing agents: | |
| 1,4-butanediol | 3.9 parts |
| Trimethylolpropane | 2.1 parts |
| Graphite fluoride powder: Cefbon-DM (a product of Central Glass Co., Ltd.; average particle diameter: 3 μm) | |

The curing agents, 1,4-butanediol and trimethylolpropane, were mixed into heat-melted urethane prepolymer. The mixture was casted in a mold previously fitted with a plate metal, and then cured by heating. The cured product was taken out of the mold and cut in the same size as in Example 1 to form a cleaning blade made of polyurethane. A dispersion of the graphite fluoride powder in a solvent of a fluorocarbon type (Daiflon S3; a product of Daikin Industries, Ltd.) was applied by the dipping method, to the top of the cleaning blade. The cleaning blade of the present invention was thus prepared.

COMPARATIVE EXAMPLE 1

Elastomeric Body Forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Curing agents: | |
| 1,4-butanediol | 3.9 parts |

-continued

| | |
|---|---|
| Trimethylolpropane | 2.1 parts |

The curing agents, 1,4-butanediol and trimethylolpropane, were mixed into heat-melted urethane prepolymer. The mixture was coated in a mold previously fitted with a plate metal, and then cured by heating. The cured product was taken out of the mold and cut in the same size as in Example 1 to form a cleaning blade made of polyurethane.

COMPARATIVE EXAMPLE 2

Elastomeric Body forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Curing agents: | |
| 1,4-butanediol | 3.9 parts |
| Trimethylolpropane | 2.1 parts |
| Fluorocarbon resin powder: Lubron L-2 (a product of Daikin Industries, Ltd.; average particle diameter: 5 μm) | |

The curing agents, 1,4-butanediol and trimethylolpropane, were mixed into heat-melted urethane prepolymer. The mixture was casted in a mold previously fitted with a plate metal, and then cured by heating. The cured product was taken out of the mold and cut in the same size as in Example 1 to form a cleaning blade made of polyurethane. The fluorocarbon resin powder was rubbed over the top of the cleaning blade to prepare a cleaning blade.

COMPARATIVE EXAMPLE 3

Elastomeric Body Forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Curing agents: | |
| 1,4-butanediol | 3.9 parts |
| Trimethylolpropane | 2.1 parts |
| Fluorocarbon resin powder: Kynar #461 (a product of Pennwalt Corp.; average particle diameter: 5 μm) | |

The curing agents, 1,4-butanediol and trimethylolpropane, were mixed into heat-melted urethane prepolymer. The mixture was casted in a mold previously fitted with a plate metal, and then cured by heating. The cured product was taken out of the mold and cut in the same size as in Example 1 to form a cleaning blade made of polyurethane. The fluorocarbon resin powder was rubbed over the top of the cleaning blade to prepare a cleaning blade.

In respect of the cleaning blades prepared in the above, the initial use turn-over, initial stage cleaning performance, and images were evaluated using an electrophotographic copying machine (manufactured by Canon Inc.; Color Laser Copyer comprising an organic photosensitive member. Results of the evaluation are shown in Table 1. The coefficient of friction of each cleaning blade was also measured to obtain the results as also shown in Table 1.

Figure 3:
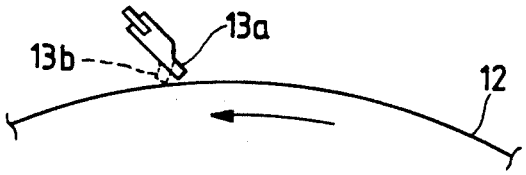
FIG. 3 is a diagrammatic view to show the relation in which the cleaning blade comes into touch with the photosensitive member.

At a linear pressure of 10 g/cm, of the cleaning blade to the photosensitive member, the cleaning blade was brought into touch with a photosensitive member 12 as shown in FIG. 3, in the direction counter to the rotational direction of the photosensitive member. The turn-over of the cleaning blade means that the top 13*a* of the blade as shown in FIG. 3 is turned in the position 3*b*. The coefficient of friction was measured using a surface properties tester (manufactured by Heidon Co.).

TABLE 1

| | Example | | Comparative Example | | |
|---|---|---|---|---|---|
| | 1 | 2 | 1 | 2 | 3 |
| Coefficient of friction: | 0.3 | 0.3 | 5.0 | 0.3 | 0.3 |
| Initial use turn-over*: | A | A | B | A | A |
| Initial stage cleaning performance**: | (1) | (1) | — | (2) | (2) |

(1) No defective copy until 5,000 sheet copying.
(2) Dot-like defective images appeared at the initial 50 sheet copying.
*In the initial use turn-over, "A" indicates that no turn-over occurred; and "B", the blade has turned over, resulting in no drive of the photosensitive member.
**In the initial stage cleaning performance, "no defective copy" means that no dot-like defective image was observed as a result of visual observation of copied images.

EXAMPLE 3

Elastomeric Body forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Graphite fluoride powder: Cefbon-DM (a product of Central Glass Co., Ltd.; average particle diameter: 3 μm) | 20 parts |
| Curing agents: | |
| 1,4-butanediol | 3.9 parts |
| Trimethylolpropane | 2.1 parts |

Figure 4:
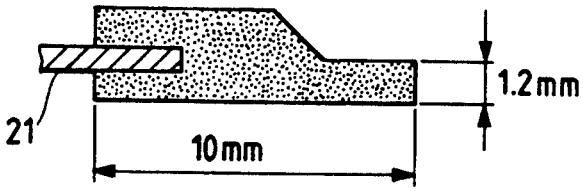
FIGS. 4 and 5 are diagrammatic cross sections each illustrating another cleaning blade according to the present invention.

The graphite fluoride powder was dispersed in heat-melted urethane prepolymer to form an urethane prepolymer containing the graphite fluoride powder. Next, the curing agents, 1,4-butanediol and trimethylolpropane, were mixed into the prepolymer. The resulting mixture was casted in a mold previously fitted with a plate metal, and then cured by heating. The cured product was taken out of the mold and cut to form a cleaning blade of 10 mm in width, 310 mm in total length and 1.2 mm in thickness at the top, made of urethane and containing the graphite fluoride. FIG. 4 shows a cross section of the resulting cleaning blade. In FIG. 4, the numeral 21 denotes the plate metal.

EXAMPLE 4

Elastomeric Body Forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Graphite fluoride powder: Cefbon-CMA (a product of Central Glass Co., Ltd.; average particle diameter: 2 μm) | 20 parts |
| Curing agents: | |
| 1,4-butanediol | 3.9 parts |
| Trimethylolpropane | 2.1 parts |

The graphite fluoride powder was dispersed in heat-melted urethane prepolymer to form an urethane prepolymer containing the graphite fluoride. Next, the curing agents, 1,4-butanediol and trimethylolpropane, were mixed into the prepolymer. The resulting mixture was casted in a mold previously fitted with a plate metal, and then cured by heating. The cured product was taken out of the mold and cut in the same size and shape as in Example 3. A cleaning blade made of urethane and containing the graphite fluoride was thus prepared.

EXAMPLE 5

Elastomeric Body Forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Graphite fluoride powder: Carbon Fluoride #2028 (a product of Asahi Glass Co., Ltd.; average particle diameter: 1 μm or less) | 15 parts |
| Curing agents: | |
| 1,4-butanediol | 3.9 parts |
| Trimethylolpropane | 2.1 parts |

The graphite fluoride powder was dispersed in heat-melted urethane prepolymer to form an urethane prepolymer containing the graphite fluoride. Next, the curing agents, 1,4-butanediol and trimethylolpropane, were mixed into the prepolymer. The resulting mixture was casted in a mold previously fitted with a plate metal, and then cured by heating. The cured product was taken out of the mold and cut in the same size and shape as in Example 3. A cleaning blade made of urethane and containing the graphite fluoride was thus prepared.

EXAMPLE 6

Elastomeric Body Forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Graphite fluoride powder: Cefbon-DM (a product of Central Glass Co., Ltd.; average particle diameter: 3 μm or less) | 20 parts |
| Curing agents: | |
| 1,4-butanediol | 4.8 parts |
| Trimethylolpropane | 1.2 parts |

Figure 5:
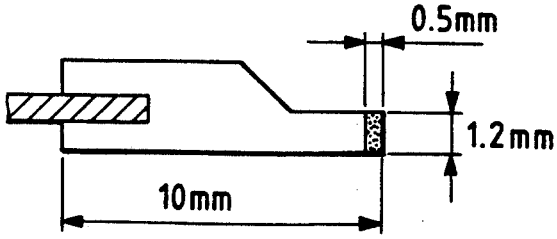

The graphite fluoride powder was dispersed in heat-melted urethane prepolymer to form an urethane prepolymer containing the graphite fluoride powder. Next, the curing agents, 1,4-butanediol and trimethylolpropane, were mixed into the prepolymer. The resulting mixture was casted in a mold previously fitted with a previously molded blade made of urethane, and then cured by heating. The cured product was taken out of the mold and cut in the same size as in Example 3. A cleaning blade having on its top with a width of 0.5 mm an urethane portion containing the graphite fluoride was thus prepared. FIG. 5 shows a diagramatic cross section of this cleaning blade.

COMPARATIVE EXAMPLE 4

Elastomeric Body Forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Curing agents: | |
| 1,4-butanediol | 3.9 parts |
| Trimethylolpropane | 2.1 parts |

The curing agents, 1,4-butanedoil and trimethylolpropane, were mixed into heat-melted urethane prepolymer. The mixture was casted in a mold, and then cured by heating. The cured product was taken out of the mold and cut in the same size and shape as in Example 3 to form a cleaning blade.

COMPARATIVE EXAMPLE 5

Elastomeric Body Forming Materials

| | |
|---|---|
| Ethylene adipate type urethane prepolymer (a product of Nippon Polyurethane Industry Co., Ltd.; Mn 1500; NCO content: 6.2 wt. %) | 100 parts |
| Fluorocarbon resin powder: Lubron L-2 (a product of Daikin Industries, Ltd.; average particle diameter: 5 μm) | 20 parts |
| Curing agents: | |
| 1,4-butanediol | 3.9 parts |
| Trimethylolpropane | 2.1 parts |

The fluorocarbon resin powder was dispersed in heat-melted urethane prepolymer to form an urethane prepolymer containing the fluorocarbon resin. Next, the curing agents, 1,4-butanediol and trimethylolpropane, were mixed into the prepolymer. The resulting mixture was casted in a mold previously fitted with a previously molded blade made of urethane, and then cured by heating. The cured product was taken out of the mold and cut. A cleaning blade with the same size and shape as in Example 6, having on its top with a width of 0.5 mm an urethane portion containing the fluorocarbon resin, was thus prepared.

In respect of the cleaning blades prepared in the above, the initial use turn-over and the cleaning performance were evaluated using an electrophotographic copying machine (manufactured by Canon Inc.; Color Laser Copyer) comprising an organic photosensitive member. Results obtained are shown in Table 2. On each cleaning blade, the coefficient of friction was measured and also a tensile test was carried out to obtain the results as also shown in Table 2.

At a linear pressure of 10 g/cm, of the cleaning blade to the photosensitive member, the cleaning blade was brought into touch with a photosensitive member 12 as shown in FIG. 3, in the direction counter to the rotational direction of the photosensitive member. The turn-over of the cleaning blade means that the top 13*a* of the blade as shown in FIG. 3 is turned in the position 3*b*. The coefficient of friction was measured using a surface properties tester (manufactured by Heidon Co.). The tensile test was carried out according to JIS-K6301, using test pieces prepared by punching out the respective cleaning blades formed as molded sheets of 2 mm thick each, to give dumbbells of #3 type.

TABLE 2

| | Example | | | | Comparative Example | | |
|---|---|---|---|---|---|---|---|
| | 3 | 4 | 5 | 6 | 4 | 5 | 6 |
| Coefficient of friction: | 0.5 | 0.5 | 0.8 | 0.5 | 5 | 2.8 | 2.8 |
| Tensile test: (kg/cm$^2$) | 320 | 360 | 280 | 330 | 330 | 120 | 120 |
| Initial use turn-over*: | A | A | A | A | B | B | A |
| Cleaning performance**: | (1) | (1) | (1) | (1) | — | — | (2) |

(1) No defective copy until 5,000 sheet copying.
(2) Defective lines appeared at 1,000 sheet copying.
*In the initial use turn-over, "A" indicates that no turn-over occurred; and "B", the blade has turned over, resulting in no drive of the photosensitive member.
**In the cleaning performance, "no defective copy" means that defective images such as lines and blanks were not observed as a result of visual observation of copied images.
***In Comparative Example 6, fluorocarbon resin powder (Lubron L-2; a product of Daikin Industries, Ltd.; average particle diameter: 5 μm) was sprinkled on the surface of the photosensitive member used, and the resulting photosensitive member was set in the electrophotographic copying machine.

As will be evident from the above results, the cleaning blade of the present invention does not cause the turn-over of the blade at its initial use and also does not cause any memory to remain on the surface of the photosensitive member, so that good images can be obtained even at the initial stage.

On the other hand, the cleaning blade of Comparative Example 1 has so high a coefficient of friction that the blade turn-over has occurred. In Comparative Examples 2 and 3, the blade turn-over has not occurred, but the electrical memory has remained on the photosensitive drum, thus having caused dot-like defective images at the initial stage.

The cleaning blade of Comparative Example 4 also has so high a coefficient of friction that the blade turn-over has occurred. The cleaning blade of Comparative Example 5 has a somewhat low coefficient of friction, but the blade turn-over has occurred. In Comparative Example 6, the blade turn-over has not occurred because of the lubricity imparted to the photosensitive member. Since, however, the fluorocarbon resin powder is not well held by the elastomeric body, the fluorocarbon resin powder has fallen off as a result of long-term copying, bringing about defective lines to give faulty images.

We claim:

1. A method of making a cleaning blade comprising the steps of:

fabricating an elastomeric blade having a cleaning portion; and applying graphite fluoride in powder form to the cleaning portion of the elastomeric blade.

2. The method of making a cleaning blade according to claim 1, wherein the graphite fluoride powder has an average particle diameter of from 1 to 8 μm.

3. The method of making a cleaning blade according to claim 1, wherein the elastomeric material is at least one material selected from the group consisting of polyurethane rubber, silicone rubber, nitrile rubber and chloroprene rubber.

4. A method of making a cleaning blade comprising the steps of:

fabricating an elastomeric blade having a cleaning portion;

applying a dispersion of graphite fluoride powder in a suitable solvent containing no resin to the cleaning portion of the elastomeric blade; and evaporating the solvent from the cleaning portion.

5. The method of making a cleaning blade according to claim 4, wherein the graphite fluoride powder has an average particle diameter of from 1 to 8 μm.

6. The method of making a cleaning blade according to claim 4, wherein the elastomeric material is at least one material selected from the group consisting of polyurethane rubber, silicone rubber, nitrile rubber and chloroprene rubber.

* * * * *